US007015443B2

(12) United States Patent
Whipple, Jr.

(10) Patent No.: US 7,015,443 B2
(45) Date of Patent: Mar. 21, 2006

(54) SHEATHED ELECTRIC HEATING ELEMENT SUPPORT BRACKET FOR RF COOKING APPLICATIONS

(75) Inventor: Robert Z. Whipple, Jr., Louden, TN (US)

(73) Assignee: Maytag Corp., Newton, IA (US)

( * ) Notice: Subject to any disclaimer, the term of this patent is extended or adjusted under 35 U.S.C. 154(b) by 15 days.

(21) Appl. No.: 10/824,415

(22) Filed: Apr. 15, 2004

(65) Prior Publication Data

US 2005/0230382 A1 Oct. 20, 2005

(51) Int. Cl.
*H05B 6/80* (2006.01)

(52) U.S. Cl. ..... 219/735

(58) Field of Classification Search ..... 219/735, 219/734, 733, 732, 678
See application file for complete search history.

(56) References Cited

U.S. PATENT DOCUMENTS

| | | | | |
|---|---|---|---|---|
| 2,875,312 A | | 2/1959 | Norton | |
| 3,963,859 A | | 6/1976 | Petersen et al. | |
| 4,013,870 A | | 3/1977 | Summers | |
| 4,241,291 A | | 12/1980 | Carnes | |
| 4,321,744 A | | 3/1982 | Carnes | |
| 5,393,248 A | * | 2/1995 | Yagi et al. | 439/595 |
| 5,442,158 A | | 8/1995 | Sawyer | |
| 6,132,084 A | * | 10/2000 | Whipple et al. | 374/131 |
| 6,472,640 B1 | * | 10/2002 | Brown et al. | 219/400 |
| 6,680,467 B1 | * | 1/2004 | Whipple, Jr. | 219/747 |
| 6,723,970 B1 | * | 4/2004 | Whipple, Jr. | 219/681 |
| 6,872,926 B1 | * | 3/2005 | Arntz et al. | 219/681 |
| 2002/0023918 A1 | | 2/2002 | Howard et al. | |

* cited by examiner

*Primary Examiner*—Daniel Robinson
(74) *Attorney, Agent, or Firm*—Diederiks & Whitelaw, PLC

(57) ABSTRACT

A sheathed electric resistive heating element support bracket constructed in accordance with the present invention includes first and second mounting portions interconnected through a transverse web portion. The web portion includes at least one heating element receiving journal and an edge portion along which is arranged a plurality of substantially circular lances. The substantially circular lances define a bore through which a mechanical fastener can pass to secure the bracket in a desired position. In this manner, the mechanical fastener and support bracket collectively serve as an electrical ground and an RF energy shield for the heating element. The heating element is secured into the journal through a snap-fit connection, while a crimping finger is also deformed over a portion of the heating element to fixedly maintain the heating element in the journal.

20 Claims, 5 Drawing Sheets

SHEATHED ELECTRIC HEATING ELEMENT SUPPORT BRACKET FOR RF COOKING APPLICATIONS

BACKGROUND OF THE INVENTION

1. Field of the Invention

The present invention pertains to the art of cooking appliances and, more particularly, to cooking appliances employing electric heating element support brackets adapted for microwave applications which, in addition to supporting a heating element within an oven, act as both a ground and an RF shield.

2. Discussion of the Prior Art

The art of cooking is currently undergoing substantial change. No longer is it the norm to have a family member home all day to prepare meals. Today, more and more consumers must rush home from work to prepare meals for themselves or their families. Time is of the essence, with the luxury of spending time preparing meals rapidly becoming a thing of the past. In light of these time constraints, consumers are demanding cooking appliances that will cook a meal in less time than conventional ovens, without sacrificing the quality of the prepared food. In order to meet these demands, manufacturers are combining conventional cooking systems with the rapid cook advantages of microwave cooking systems.

Microwaves perform a cooking process by directing a microwave or RF energy field into an oven cavity. The RF energy field is in the form of a standing wave which reflects about the oven cavity and impinging upon a food item. As the RF energy fields impinge upon the food item, the energy fields are converted into heat through two mechanisms. The first or ionic is constituted by the linear acceleration of ions, generally in the form of salts, present within the food item. The second is the molecular excitation of polar molecules, primarily water, present within the food item.

When introducing microwave systems into conventional ovens, there are several considerations which must be addressed. For instance, metal components within the oven cavity must be grounded in order to prevent damage to the microwave components. Metal located in the oven cavity may potentially reflect a portion of the RF energy field back into the magnetron. The reflected RF energy is dissipated as heat within the magnetron which causes distortions in the energy field, as well as ultimately leading to total failure of the component. In order to substantially eliminate this problem, an RF energy shield is needed to protect the magnetron. One effective method of establishing a shield is to properly ground all metal components. In this manner, the metal components will not act in a manner similar to that of an antenna transmitting the RF energy back into the magnetron. This is particularly true in connection with the mounting of metal components with screw or other mechanical fasteners which can act as antennae for microwaves, with arcing being a potential problem.

In light of the above, a primary concern in conventional ovens having an electric heating element is the particular mounting and placement of the element within the oven. Placing the heating element in the oven cavity where it is exposed to microwave energy requires specific design considerations. Mechanical fasteners and support brackets used to secure the element to the oven can act as an antenna which focuses the RF energy and causes arcing within the oven. Continued arcing reduces the operational life of the magnetron, while also decreasing the overall efficiency of the appliance. Based on the above, there exists a need in the art of cooking for an electric heating element support bracket which can be arranged within the oven cavity. Particularly, there exists a need for a support bracket which serves as a ground for an electric heating element so as to provide an RF shield for preventing reflected microwave energy from damaging internal system components.

SUMMARY OF THE INVENTION

The present invention is directed to a cooking appliance including both electric and microwave heat sources. More specifically, the invention is directed to a heating element support bracket suitable for use in RF applications. Specifically, the heating element support bracket includes first and second mounting surfaces interconnected through a transverse heating element support web. In one form of the invention, the heating element support web is constituted by an element support surface having at least one element receiving journal and an edge portion along which a plurality of substantially circular lances are arranged. More specifically, the substantially circular lances define a bore, through which a mechanical fastener can pass, for securing the bracket to an oven cavity surface. In this manner, the fastener serves as an electrical ground in order to establish an RF energy shield for the electric heating element.

In accordance with a preferred form of the present invention, the element support web includes a second element receiving journal maintained in a spaced relationship from the first journal through an intermediate member. In this manner, a heating element having a plurality of heating coils may be supported by the bracket. In a preferred arrangement, a V-shape notch is arranged in at least one portion of the intermediate member such that the application of a force to the notch will cause a crimping effect to fix the element within the journal.

In accordance with a more preferred form of the invention, a shoulder portion is formed in each journal to establish a snap-fit for the heating element. In any event, additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
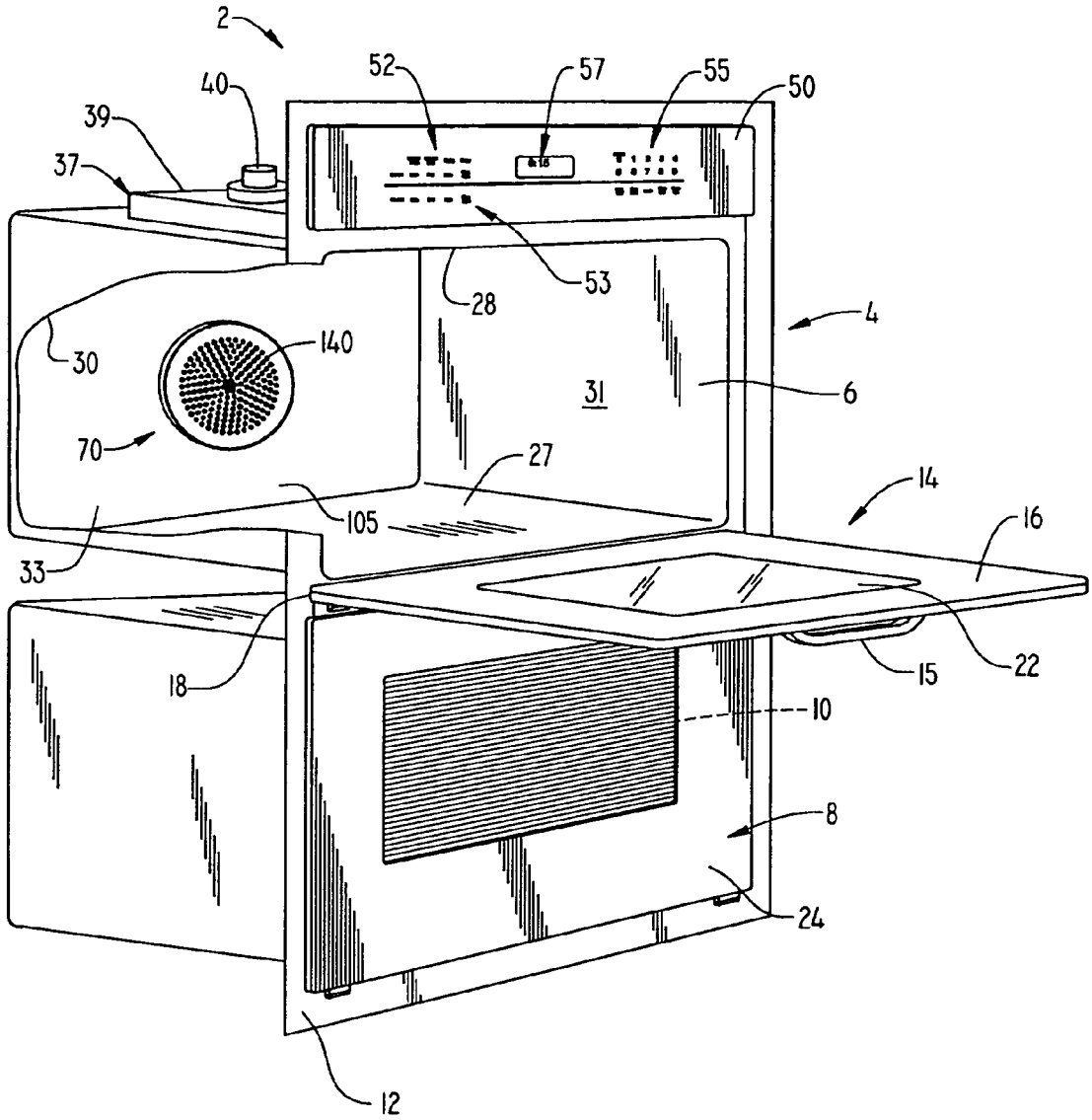
FIG. 1 is a perspective view of a wall oven including a microwave and convection cooking system constructed in accordance with the present invention.

With initial reference to FIG. 1, a cooking appliance constructed in accordance with the present invention is generally shown at 2. Although cooking appliance 2 is depicted as a dual wall oven, it should be understood that the present invention is not limited to this model type and can be incorporated into various types of oven configurations, e.g., cabinet mounted ovens, free standing ranges and slide-in ranges. In the embodiment shown, cooking appliance 2 includes an upper oven 4 having an upper oven cavity 6 and a lower oven 8 having a lower oven cavity 10. In the embodiment shown, upper oven 4 is provided to perform a combination microwave/convection cooking process, and lower oven 8 is provided to perform a standard cooking operation. As shown, cooking appliance 2 includes an outer frame 12 for supporting both upper oven cavity 6 and a lower oven cavity 10.

In a manner known in the art, a door assembly 14 is provided to selectively provide access to upper oven cavity 6. As illustrated, door assembly 14 includes a handle 15 arranged at an upper portion 16 thereof. Door assembly 14 is adapted to pivot at a lower portion 18 to enable selective access to within oven cavity 6. In a manner also known in the art, door 14 is provided with a transparent zone 22 for viewing the contents of oven cavity 6 while door 14 is closed. In addition, a seal (not shown) is provided about a peripheral edge of door assembly 14 to prevent oven gases from escaping from within oven cavity 6 during a cooking operation. In a similar manner to that described above with respect to door assembly 14, a second door assembly 24 is provided for lower oven 8.

As best seen in FIG. 1, oven cavity 6 is preferably defined by a bottom portion 27, an upper portion 28, opposing side portions 30 and 31 and a rear portion 33. In the preferred embodiment, arranged above upper oven 4 is a microwave cooking system generally indicated at 37. As shown, microwave cooking system 37 includes a waveguide 39 having arranged thereon a microwave emitter or magnetron 40. As further shown in FIG. 1, cooking appliance 2 includes an upper control panel 50 arranged above upper oven 4 and carried at least partially by frame 12. In the embodiment shown, control panel 50 includes first and second rows of oven control buttons 52 and 53 for programming, in combination with a numeric pad 55 and a display 57, particular cooking operations for upper and lower ovens 4 and 8 respectively. Since the general programming and operation of cooking appliance 2 is known in the art and does not form part of the present invention, these features will not be discussed further here.

In general, the structure described above with respect to cooking appliance 2 is already known in the art and does not constitute part of the present invention. Therefore, this structure has only been described for the sake of completeness. Instead, the present invention is particularly directed to a convection cooking system and, more particularly, to a heating element support bracket adapted to position a heating element within the convection cooking system, while providing a ground for the heating element. In this manner, the heating element can be exposed to an RF energy field without causing damage to magnetron 40.

Figure 2:
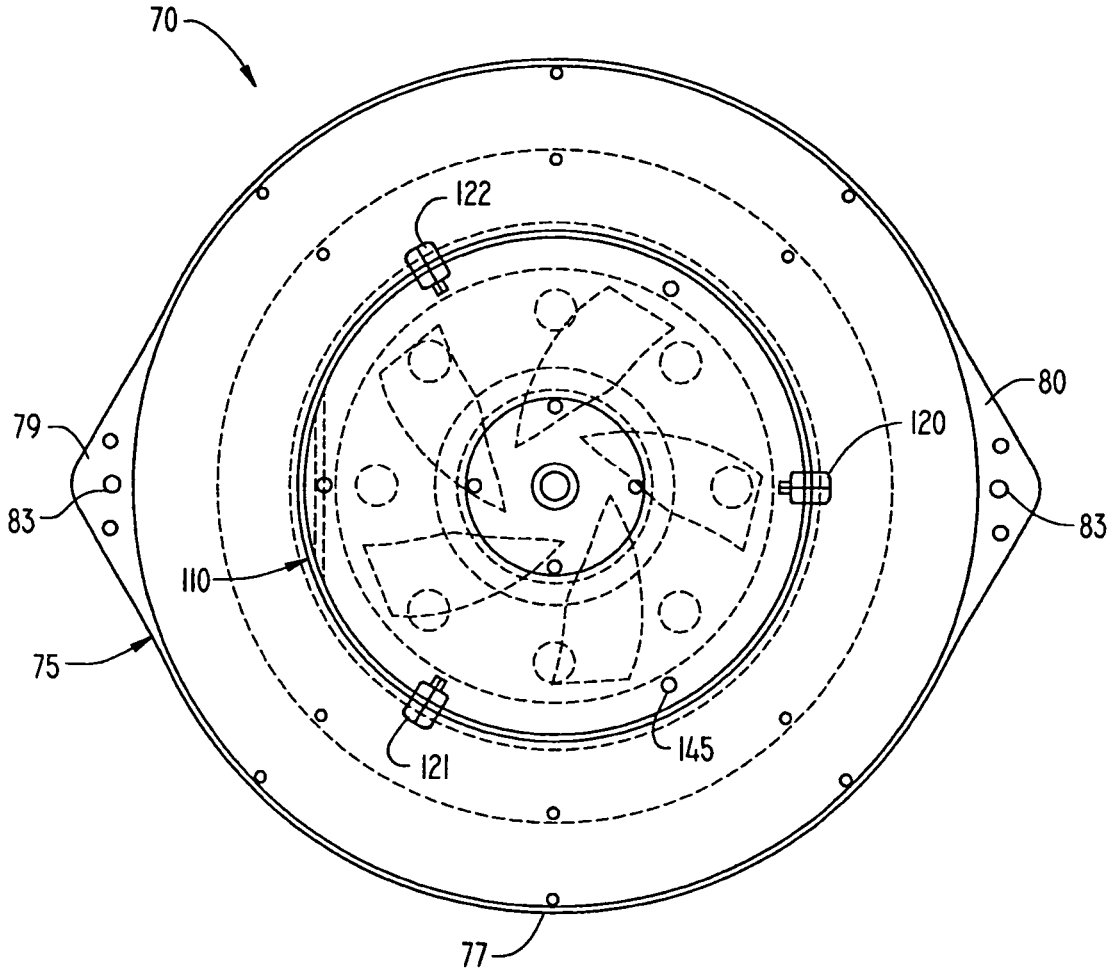
FIG. 2 is a top view of the convection cooking system including a plurality of heating element support bracket arranged in accordance with the present invention.
Figure 3:
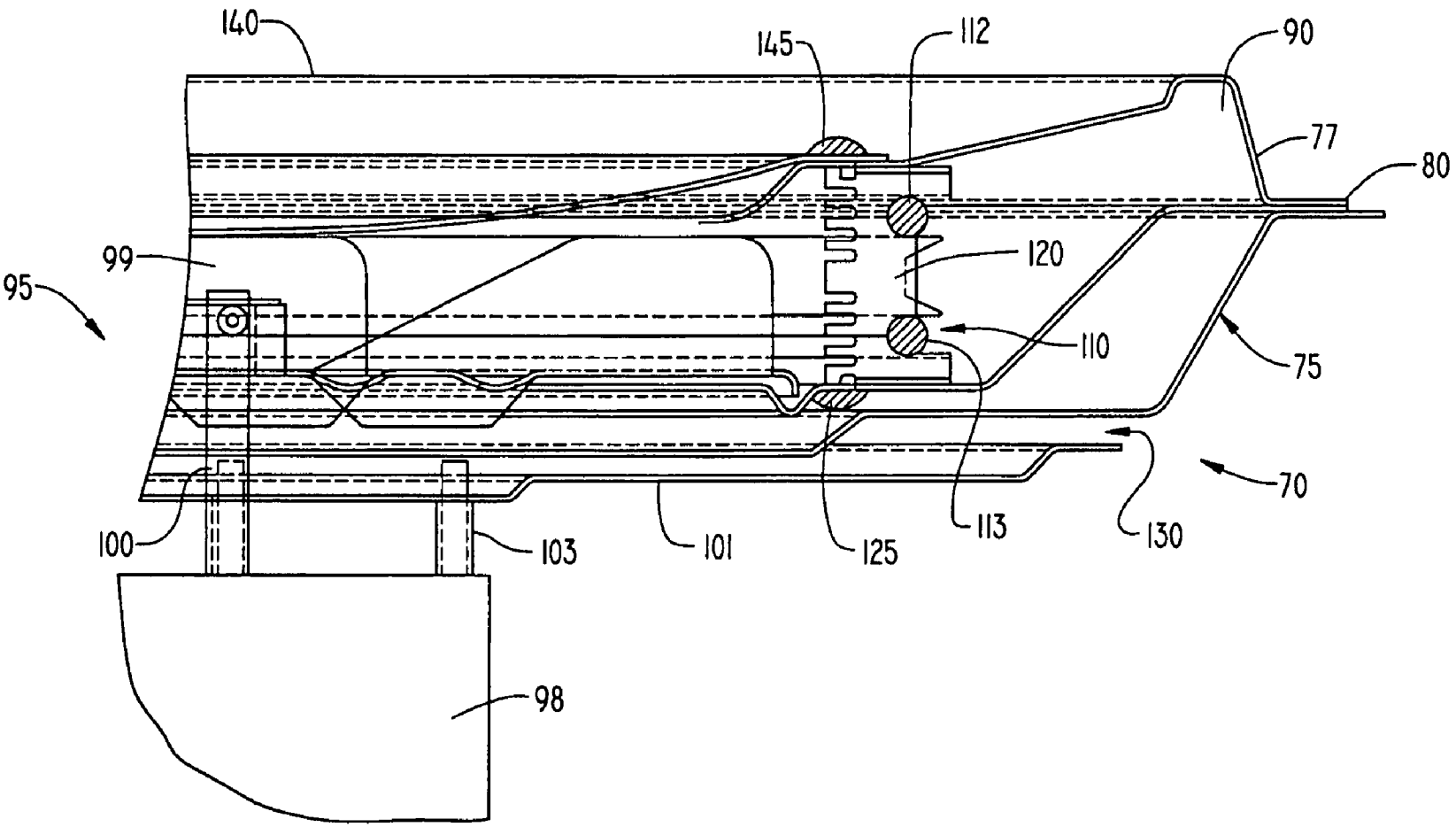
FIG. 3 is a cross-sectional view of the convection cooking system of FIG. 2.

In accordance with a preferred embodiment of the present invention, cooking appliance 2 further includes a convection cooking system generally indicated at 70 in FIGS. 1–3. As shown in FIGS. 2 and 3, convection cooking system 70 includes a convection fan housing 75 having an outer peripheral portion 77. Arranged at diametrically opposing positions along outer peripheral portion 77 are a pair of mounting flanges 79 and 80 each of which includes a respective plurality of apertures, two of which are indicated at 83, for securing convection fan housing 75 to oven cavity 6.

As best seen in FIG. 3, housing 75 includes a heating or combustion chamber 90 within which are arranged parts of a fan assembly 95. In the embodiment shown, fan assembly 95 includes a motor 98 operatively connected to a fan or impeller 99 through a drive shaft 100. As illustrated, motor 98 is secured to a surface portion 101 of fan housing 75 through a plurality of mounting studs 103. Further arranged within heating chamber 90 is a heating element 110 which extends about an outer periphery of fan 99. In a preferred form of the invention, heating element 110 includes first and second coils 112 and 113 that are supported within heating chamber 90 by a plurality of heating element support brackets 120–122 (also see FIG. 5). In a preferred form of the invention, support brackets 120–122 are secured to a bottom portion of heating chamber 90 through a mechanical fastener 125, preferably a screw. In accordance with the most preferred embodiment, mechanical fastener 125 establishes a ground that effectively shields heating element 110 from the effects of microwave energy generated by magnetron 40. With this arrangement, the possibility of heating element 110 reflecting a portion of the RF energy field back into magnetron 40 is substantially eliminated. Finally, housing 70 includes an inlet portion 130 adapted to provide access for an incoming air flow which transforms to a convective heating air stream as the airflow passes over heating element 110. After the convection air flow passes over heating element 110, the airflow is directed into oven cavity 6 through a cover portion 140 secured to housing 75 as shown best in FIGS. 1 and 3.

Figure 4:
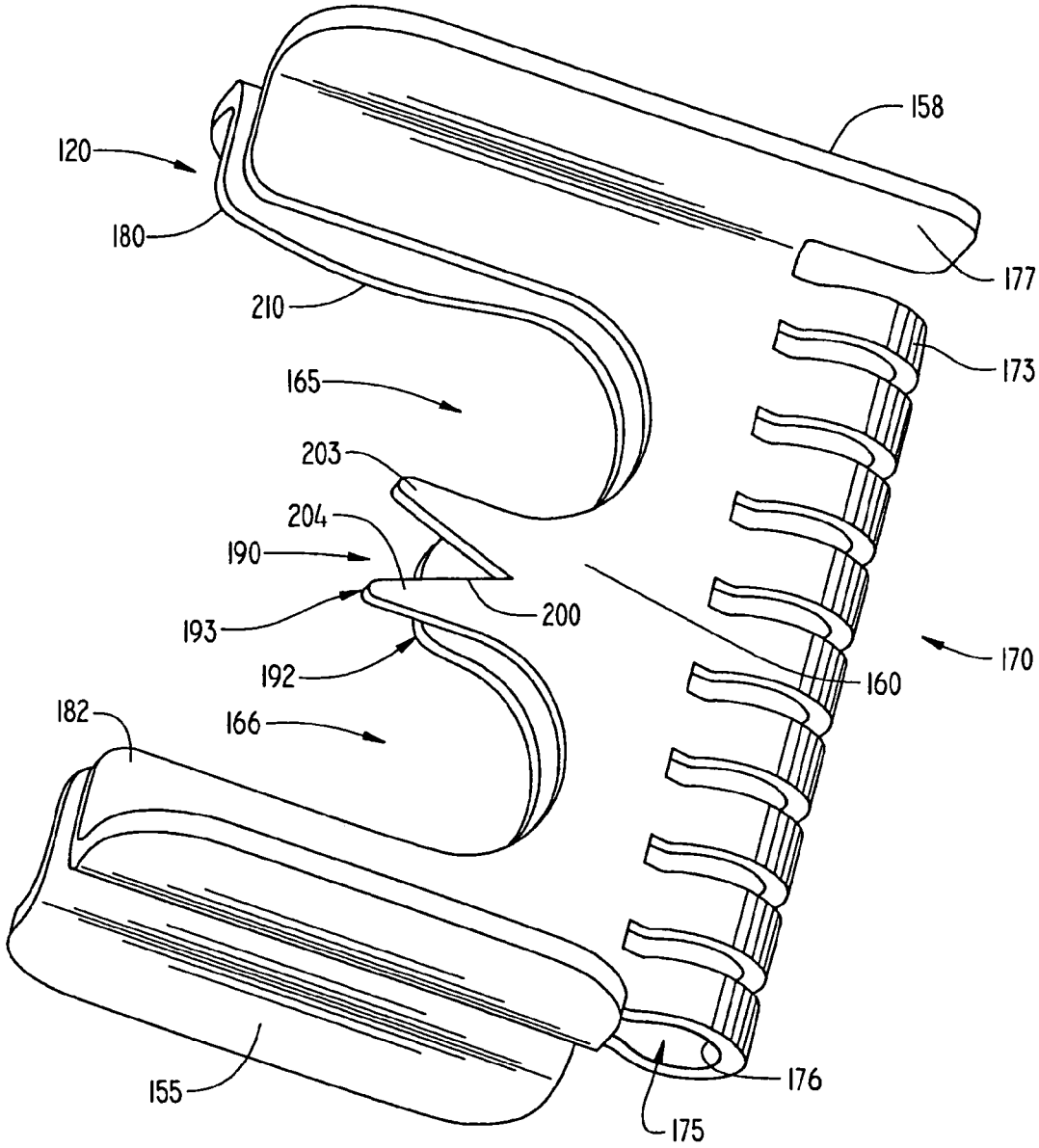
FIG. 4 is a plan view of the heating element support bracket of FIG. 2.
Figure 5:
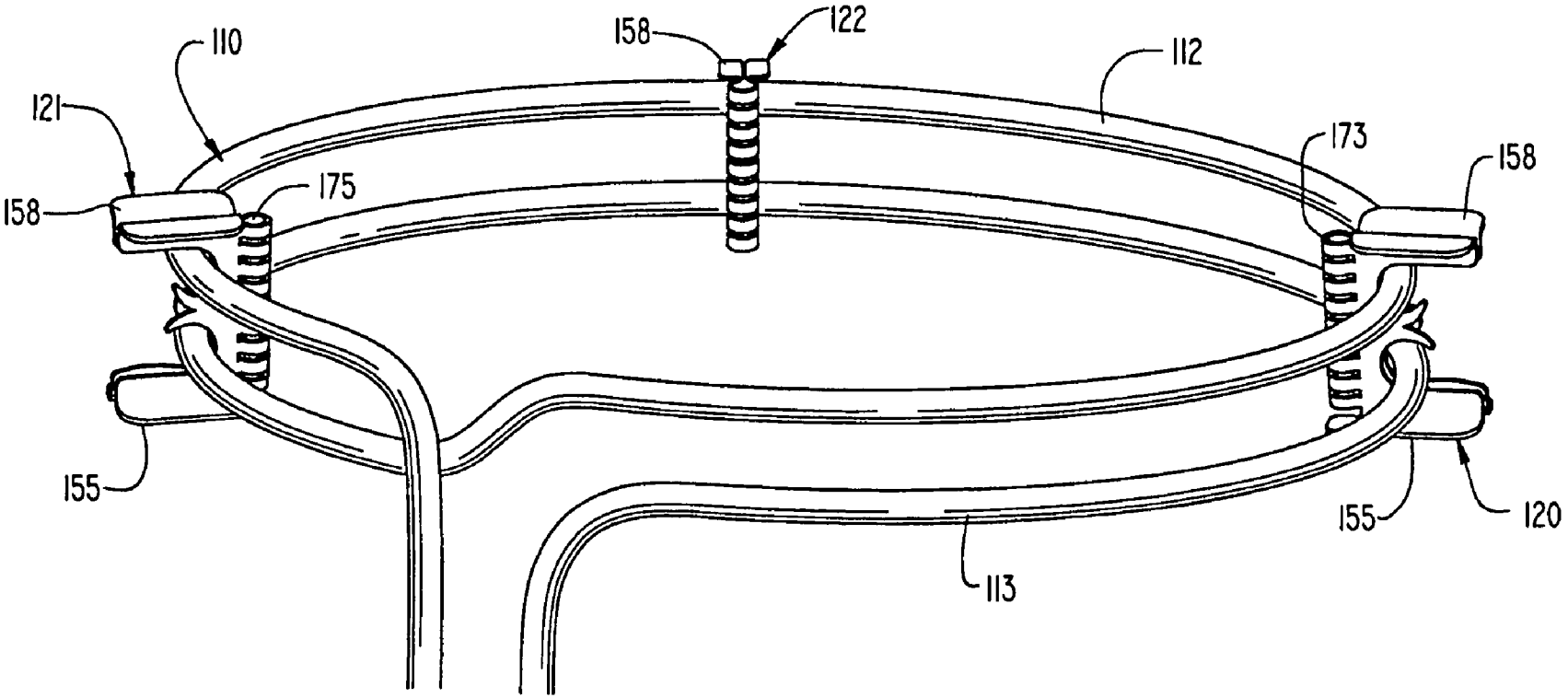
FIG. 5 is a perspective view of the heating element support bracket of FIG. 4 secured to a heating element in accordance with a preferred embodiment of the present invention.

Reference will now be made to FIGS. 4 and 5 in describing the specific structure of each heating element support bracket 120–122. Since the structure of each support bracket 120–122 is identical, a detailed description of support bracket 120 will be made and it is to be understood that support brackets 121 and 122 have commensurate structure. In accordance with the preferred embodiment of the present invention, heating element support bracket 120 includes a first mounting surface 155 and a second mounting or cover supporting surface 158 separated through a transverse web portion 160. As shown, transverse web portion 160 includes first and second heating element receiving journals 165 and 166 adapted to receive a respective one of coils 112 and 113 of heating element 110. Web portion 160 further includes an edge portion 170 defined by a plurality of substantially circular lances, one of which is indicated at 173. In accordance with this preferred embodiment, lances 173 define a central bore 175 adapted to receive one of mechanical fasteners 125 for securing bracket 120 within fan housing 75. More specifically, in accordance with one preferred embodiment of the invention, central bore 175 has a first end 176 which is open, and a second end 177 which is closed by a terminal wall portion 177 of second mounting surface 156. Preferably, bracket 120 is formed from a single, stamped sheet of metal which is folded about an axis defined by central bore 175, thereby resulting in the formation of a first half 180 and a second half 182.

In the embodiment shown, heating element receiving journals 165 and 166 are separated by an intermediate member 190 having a first portion 192 associated with first half 180, and a second portion 193 associated with second half 182. Second portion 193 includes a V-shaped notch 200 having a first crimp finger 203 and second crimp finger 204. With this arrangement, once coils 112 and 113 of heating element 110 are positioned into receiving journals 165 and 166, a force applied to V-shaped notch 200 will outwardly deform first and second crimping fingers 203 and 204, thereby fixing coils 112 and 113 into journals 165 and 166.

In addition to crimping fingers 203 and 204, each outside edge portion of element receiving journals 165 and 166 includes a respective shoulder portion, one of which is shown at 210. With this arrangement, each shoulder portion 210 provides a snap-fit for a respective coil 112, 113. With this arrangement, coils 112 and 113 are maintained in position within support bracket 120 prior to deforming first and second crimp fingers 203 and 204.

As set forth above, brackets 120–122 establish a ground between heating element 110 and oven 2. In this manner, microwave cooking system 37 can be operated in conjunction with electric heating element 110 of convection cooking system 70 without requiring additional shielding for magnetron 40. Also, given the arrangement of fastener 125 within lances, with a tip thereof (not shown) terminating adjacent second end 177 of mounting surface 156, fastener 125 will not act as an antenna for the microwave energy. In any case, although described with reference to a preferred embodiment of the invention, it should be readily understood that various changes and/or modifications can be made to the invention without departing from the spirit thereof. For instance, while the microwave cooking system is shown mounted on an upper surface of the oven cavity and the convection cooking system mounted to a rear portion, the particular positioning of these systems could be altered depending on the particular model and structure of the cooking appliance. In general, the invention is only intended to be limited by the scope of the following claims.

I claim:

1. A cooking appliance comprising:

an oven cavity adapted to receive a food item to be exposed to a cooking operation;

a microwave generator adapted to emit an RF energy field into the oven cavity to selectively perform at least a portion of the cooking operation;

an electric heating element positioned to heat the oven cavity during the cooking operation;

a heating element support bracket including first and second mounting surface portions interconnected through a web portion, said web portion including at least one heating element receiving journal within which the heating element is positioned, and an edge portion, along which are arranged a plurality of substantially circular lances defining a bore; and a mechanical fastener extending through the bore for mounting the support bracket, with the mechanical fastener providing an electrical ground and, in combination with the support bracket, an RF energy shield for the heating element.

2. The cooking appliance according to claim 1, wherein the at least one heating element receiving journal includes a first receiving journal and a second receiving journal, said second receiving journal being spaced from the first receiving journal by an intermediate member, said heating element including first and second coils supported in the first and second receiving journals respectively.

3. The cooking appliance according to claim 2, wherein the heating element constitutes a sheathed resistance-type heating element.

4. The cooking appliance according to claim 2, wherein the intermediate member includes a crimp element which clamps the heating element within the at least one heating element receiving journal.

5. The cooking appliance according to claim 4, wherein the crimp element is defined by a V-shape notch formed in the intermediate portion, said V-shaped notch defining first and second crimp fingers, said crimp fingers being adapted to maintain the first and second coils within the first and second receiving journals respectively.

6. The cooking appliance according to claim 1, further comprising: a shoulder member arranged within the at least one heating element receiving journal, said shoulder member providing a snap-fit for the heating element.

7. The cooking appliance according to claim 1, further comprising: a forced air convection system including a housing, a convection fan positioned in the housing, and the heating element, said convection fan being adapted to direct a flow of convection air over the heating element and into the oven cavity to perform a portion of the cooking process.

8. The cooking appliance according to claim 7, wherein the heating element support bracket mounts the heating element within the housing.

9. The cooking appliance according to claim 8, further comprising: an air inlet opening into the housing, with the air inlet being located on a side of the convection fan opposite to the oven cavity.

10. The cooking appliance according to claim 1, wherein the heating element support bracket is formed from a single piece of metal which is folded to define the plurality of substantially circular lances along an edge portion of the heating element support bracket.

11. A cooking appliance comprising:

an oven cavity adapted to receive a food item to be exposed to a cooking operation;

a microwave generator adapted to emit an RF energy field into the oven cavity to selectively perform at least a portion of the cooking operation;

an electric heating element positioned to heat the oven cavity during the cooking operation;

a heating element support bracket including first and second mounting surface portions interconnected through a web portion, said web portion including at least one heating element receiving journal within which the heating element is positioned, and an edge portion, formed from a single piece of metal which is bent to define two side portions and an edge portion, with said edge portion defining a bore; and a mechanical fastener extending through the bore for mounting the support bracket, with the mechanical fastener providing an electrical ground and, in combination with the support bracket, an RF energy shield for the heating element.

12. The cooking appliance according to claim 11, wherein the at least one heating element receiving journal includes a first receiving journal and a second receiving journal, said second receiving journal being spaced from the first receiving journal by an intermediate member, said heating element including first and second coils supported in the first and second receiving journal respectively.

13. The cooking appliance according to claim 12, wherein the heating element constitutes a sheathed resistance-type heating element.

14. The cooking appliance according to claim 12, wherein the intermediate member includes a crimp element which clamps the heating element within the at least one heating element receiving journal.

15. The cooking appliance according to claim 14, wherein the crimp element is defined by a V-shape notch formed in the intermediate portion, said V-shaped notch defining first and second crimp fingers, said crimp fingers being adapted to maintain the first and second coils within the first and second receiving journals respectively.

16. The cooking appliance according to claim 11, further comprising:

a shoulder member arranged within the at least one heating element receiving journal, said shoulder member providing a snap-fit for the heating element.

17. The cooking appliance according to claim 11, further comprising:

a forced air convection system including a housing, a convection fan positioned in the housing, and the heating element, said convection fan being adapted to direct a flow of convection air over the heating element and into the oven cavity to perform a portion of the cooking process.

18. The cooking appliance according to claim 17, wherein the heating element support bracket mounts the heating element within the housing.

19. The cooking appliance according to claim 18, further comprising:

an air inlet opening into the housing, with the air inlet being located on a side of the convection fan opposite to the oven cavity.

20. The cooking appliance according to claim 11, wherein the heating element support is formed from a single piece of metal, including two portions which are folded to define a plurality of substantially circular lances, said bore being defined by the plurality of substantially circular lances.

* * * * *